United States Patent [19]

Semler

[11] 4,117,556

[45] Oct. 3, 1978

[54] FLUSH WATER CONSERVER

[75] Inventor: Oskar A. Semler, Belmont, Calif.

[73] Assignee: Eleonore Josephine Semler, Belmont, Calif.

[21] Appl. No.: 751,682

[22] Filed: Dec. 17, 1976

Related U.S. Application Data

[63] Continuation-in-part of Ser. No. 690,958, May 28, 1976.

[51] Int. Cl.[2] ..... E03D 5/02

[52] U.S. Cl. ..... 4/325; 4/381; 4/382

[58] Field of Search ..... 4/34, 37, 52, 53, 54, 4/55, 67 R, 67 A, 249

[56] References Cited

U.S. PATENT DOCUMENTS

| | | | |
|---|---|---|---|
| 2,526,294 | 10/1950 | Stegeman | 4/67 A |
| 2,532,977 | 12/1950 | White | 4/67 A |
| 2,690,567 | 10/1954 | Quebbeman | 4/67 A |
| 2,724,838 | 11/1955 | Wirth | 4/67 A |
| 3,076,974 | 2/1963 | Sorensen | 4/67 R |
| 3,141,177 | 7/1964 | Kertell | 4/67 R |
| 3,555,572 | 1/1971 | Thomas | 4/52 |
| 3,787,902 | 1/1974 | McCombs | 4/67 A |

FOREIGN PATENT DOCUMENTS

| | | | |
|---|---|---|---|
| 19,214 | 8/1935 | Australia | 4/53 |

*Primary Examiner*—Herbert F. Ross
*Attorney, Agent, or Firm*—Schapp and Hatch

[57] ABSTRACT

A flush water conserver adapted for easy retrofitting to existing standard toilet flush tanks is disclosed. The standard trip lever fixed to the pivot shaft of the toilet operating handle is replaced with a trip lever mounted on a pivot which is located between the operating handle pivot shaft and the adjacent sidewall of the flush tank. A rocker is affixed to the operating handle pivot shaft. This rocker is located below the new trip lever and the new trip lever rests on it. Thus, the new trip lever is raised when the operating handle is rocked in either direction. A control float is provided, and a stop is affixed to the flush ball stem. The stop is so constructed and located that when, during a flushing operation, the water in the flush tank has only partially receded, the weight of the control float is brought to bear on the stop, and thus the flush ball is pressed toward its seat while the control float continues to drop with the receding water. The location of the stop is such that the downward force imparted to the flush ball by the added weight of the control float causes the flush ball to come into contact with its seat and cut off the flow of flush water out of the flush tank while a considerable part of the flush water remains in the flush tank. A latch is provided for selectively preventing the control float from dropping with the receding water or permitting the control float to drop with the receding water. The latch is positioned by the operation of the toilet operating handle so that the latch prevents the control float from dropping when the operating handle is depressed and permits the control float to drop when the operating handle is raised.

6 Claims, 8 Drawing Figures

FLUSH WATER CONSERVER

CROSS-REFERENCE TO RELATED APPLICATION

This application is a continuation-in-part of U.S. patent application Ser. No. 690,958, filed May 28, 1976.

BACKGROUND OF THE INVENTION

1. Field of the Invention

The present invention relates to flush water conservation apparatus, and more particularly to flush water conservation apparatus adapted for easy retrofitting to existing standard toilet flush tanks.

2. Description of the Prior Art

Flush water conservers are known in the prior art. The flush water conservers of the prior art, however, have in general either required continued attention by the user, who was required to manipulate the toilet operating handle or an additional auxiliary control in a particular manner to terminate the flushing action early, or required that a large percentage of all of the well-known elements found in the standard flush tank be replaced with new, complex mechanisms.

SUMMARY OF THE INVENTION

Accordingly, it is an object of the present invention to provide a simple and inexpensive flush water conservation system adapted for retrofitting to existing standard toilet flush tanks of the well-known type, which system requires the replacement of a minimum number of the existing standard parts found in existing standard toilet flush tanks.

Another object of the present invention is to provide a flush water conservation system which can be installed in an existing standard toilet flush box by an ordinary handyman or anyone else having but limited acquaintance with existing standard flush toilet mechanisms.

A further object of the present invention is to provide a flush water conservation system which is operated by the operating handle of existing standard toilet flush tanks without the manipulation of any added control members.

A yet further object of the present invention is to provide a flush water conservation system which is entirely automatic, in the sense that once the user has deflected the toilet operating handle (downwardly for full flush or upwardly for short, water-economizing flush) the user can immediately leave and need not stand by to terminate the flushing operation at some intermediate point.

Other objects of the present invention will in part be obvious and will in part appear hereinafter.

The present invention, accordingly, comprises the features of construction, combinations of elements, and arrangements of parts which will be exemplified in the constructions hereinafter set forth, and the scope of the invention will be indicated in the claims.

In accordance with a principal feature of the present invention a flush water conserver is provided which does not require the selection of operating handles nor the maintaining of an operating handle in its operated position.

In accordance with another feature of the present invention, the parts of a flush water conserver embodying the present invention are similar in many particulars to the parts of an existing standard toilet flush tank mechanism, whereby these parts of the flush water conservation system of the invention may be easily and cheaply fabricated by the use of tools and techniques already well known in the plumbing supplies industry.

For a fuller understanding of the nature and objects of the invention reference should be had to the following detailed description taken in connection with the accompanying drawings.

DESCRIPTION OF THE PREFERRED EMBODIMENTS

Figures 1, 2:
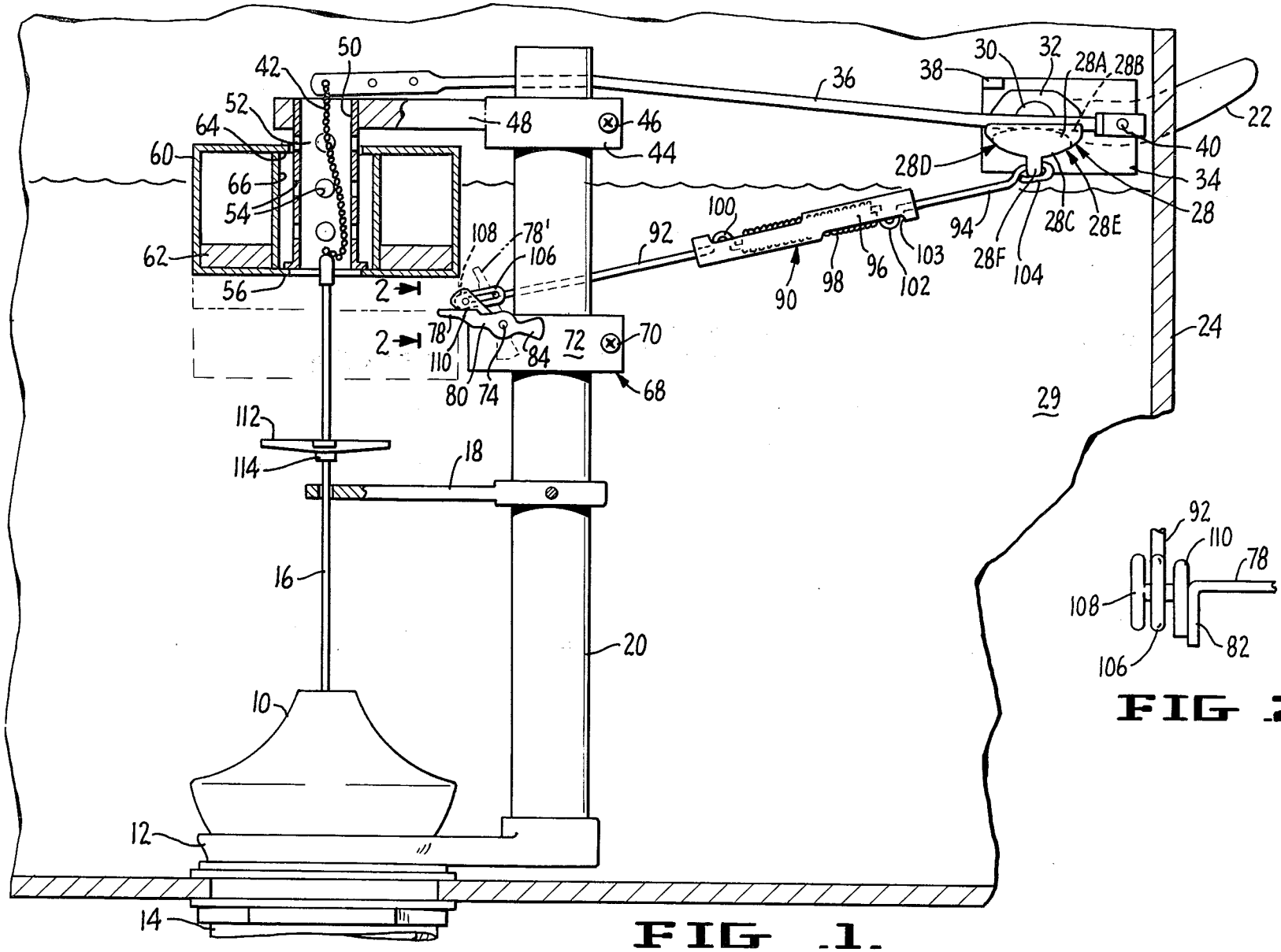
FIG. 1 is a fragmentary view in elevation of a toilet flush tank of the well-known type equipped with the flush water conservation system of a first preferred embodiment of the present invention.
FIG. 2 is an enlarged fragmentary elevational view taken on line 2—2 of FIG. 1.

Referring now to FIGS. 1 and 2, there is shown a flush water conserver constructed in accordance with a first preferred embodiment of the present invention installed in a toilet flush tank of the well-known type. As will be evident to those having ordinary skill in the art, the water inlet valve and its associated control mechanism has been omitted from FIG. 1 for clarity of illustration. The flush ball 10, flush valve seat 12, flush water discharge conduit 14, flush ball stem 16, ball stem guide 18, overflow pipe 20, operating handle 22, and the flush tank 24 itself, are all standard, unmodified parts, commonly available in plumbing supply shops.

As will also be evident to those having ordinary skill in the art, FIG. 1 is a view taken from a position behind flush tank 24, i.e., from the side of the flush tank opposite the toilet itself.

In the well-known manner, operating handle 22 is affixed to one end of a short pivot shaft 26 (not shown). A trip lever lifter or rocker 28 is affixed to the inner end of pivot shaft 26 opposite operating handle 22, and thus trip lever lifter 28 rocks about the axis of pivot shaft 26 whenever operating handle 22 is correspondingly rocked by the user of the toilet equipped with the flush water conserver of the first preferred embodiment.

In the well-known manner, pivot shaft 26 passes through a close-fitting threaded sleeve 30 which itself passes through a suitable close-fitting opening in the front face 29 of flush tank 24.

Also, in the well-known manner, threaded sleeve 30 is provided at one end with an outwardly projecting flange, which may be made from the same material as threaded sleeve 30 or from a different material. A nut 32 is provided for the purpose of coacting with threaded sleeve 30 to retain sleeve 30 in said opening in front face 29, nut 32 bearing against the inside of front face 29 (visible in FIG. 1) and the flange of threaded sleeve 30 bearing against the outside of front face 29.

Referring now to FIG. 1, it will be seen that a plate 34 surrounds threaded sleeve 30 and is located between nut 32 and the inside surface of front face 29. In the course of installing the device of the preferred embodiment in flush tank 24 threaded sleeve 30 is passed through said opening in front face 29 until said flange bears against the outer surface of front face 29; a suitable, close-fitting opening in plate 34 is brought into engagement with the inner end of threaded sleeve 30; plate 34 is brought into contact with the inner surface of front face 29; nut 32 is threaded onto threaded sleeve 30; and nut 32 is advanced until it clamps plate 34 and front face 29 between itself and said flange of threaded sleeve 30, thus securing plate 34 to front face 29 in such manner that it cannot be rotated about the axis of threaded sleeve 30. When, due to the condition of the inner surface of flush tank 24, or for other reasons, the frictional engagement between plate 34 and the inner surface of front face 29 is not sufficient to prevent plate 34 from rotating about the axis of threaded sleeve 30, other means may be provided to positively prevent rotation of plate 34 without departing from the scope of the present invention.

It is to be further understood that while the above-described threaded sleeve 30, associated nut 32, and pivot shaft 26 provide a conventional and convenient way to maintain plate 34 in its operating position and interconnect operating handle 22 with trip lever lifter 28, this particular mechanical arrangement does not constitute a limitation of the present invention, and the present invention embraces installations in which the operating handle pivot arrangement differs substantially in structural detail therefrom.

It will be apparent from the above, then, that operating handle 22 (FIG. 1) is directly connected to rocker 28 for conjoint pivoting therewith about the axis of nut 32, and that plate 34 is not rotatable about the axis of nut 32.

As may also be seen in FIG. 1, plate 34 serves as a mounting plate for a trip lever 36 which in many particulars resembles a standard flush tank trip lever, and may easily be fabricated by the same type of manufacturing equipment and facilities which are used to fabricate standard toilet tank trip levers.

Referring again to FIG. 1, it will be seen that a finger 38 projects forwardly (toward the view of FIG. 1) from mounting plate 34. Finger 38 projects sufficiently far outwardly from the near surface of mounting plate 34 (as seen in FIG. 1) so that it overlies trip lever 36 and acts as a stop to limit the upward movement of trip lever 36. For this reason, finger 38 will hereinafter be called the "trip lever stop," or simply the "stop," where the context does not admit of confusion.

Also affixed to mounting plate 34 is trip lever pivot 40. The pivot axis of trip lever pivot 40 lies substantially perpendicular to the plane of mounting plate 34, and thus trip lever 36 is displaced substantially parallel to the front face of flush tank 24 when it is rotated about trip lever pivot 40. The maximum upward displacement of trip lever 36 is determined by stop 38. The lowest downward displacement of trip lever 36 is determined by rocker 28 when rocker 28 is in its neutral or non-operating position, as shown in FIG. 1.

Referring again to FIG. 1, it will be seen that rocker 28 is so shaped as to define an upwardly projecting flange 28A which lies behind trip lever 36 (toward the viewer of FIG. 1) when trip lever 36 is in its position of rest, as shown in FIG. 1. Rocker 28 also comprises another upwardly projecting flange 28B (behind trip lever 36 as shown in FIG. 1), and a main body 28C. When trip lever 36 is in its rest position, as shown in FIG. 1, it lies in a channel defined by flanges 28A and 28B and main body 28C. Main body 28C has an inner end 28D and an outer end 28E, both shown dashed in FIG. 1. Rocker 28 also comprises an eye 28F, the purpose of which will be explained hereinbelow.

As will now be understood from FIG. 1, trip lever 36 may be rotated upwardly about pivot 40, and brought into contact with stop 38, by rocking rocker 28 to a sufficient extent in either direction of rotation about the axis of threaded sleeve 30. It follows, then, that depressing operating handle 22 to the maximum extent possible will result in tilting trip lever 36 upwardly about pivot 40 until it contacts stop 38, and raising operating handle 22 to the maximum extent possible will also result in tilting tip lever 36 about pivot 40 in the same direction of rotation until it contacts stop 38.

As may also be seen in FIG. 1, the upper end of a short length of ball chain 42 is fastened to the outer end of trip lever 36, remote from pivot 40, and the lower end of ball chain 42 is fastened to the upper end of flush ball stem 16. The lower end of flush ball stem 16 is affixed to the upper portion of flush ball 10 in the well-known manner.

Thus, it will be seen that when trip lever 36 is raised against stop 38, by either depressing operating handle 22 as far as possible or raising operating handle 22 as far as possible, flush ball 10 will be lifted from flush valve seat 12, and thus water will be allowed to run out of flush tank 24 through flush water discharge conduit 14 to flush the associated toilet in the well-known manner.

When operating handle 22 is fully depressed full flushing will thus take place in the well-known manner.

As will now be explained, however, raising, rather than depressing, the operating handle 22 in the device of the preferred embodiment results in what will be called a "short flush" herein, i.e., a flushing action which commences in the normal manner but terminates early when flush ball 10 is forced to return to contact with flush valve seat 12 before the water level in flush tank 24 has dropped sufficiently to lower flush ball 10 onto flush valve seat 12 in the well-known manner, and thus the amount of water passing out through discharge conduit 14 is only a fraction of the amount which passes through discharge conduit 14 during a normal or full flush, i.e., when operating handle 22 is depressed in the usual manner. The amount of water passing through conduit 14 when operating handle 22 is raised (short flush) will be enough to adequately flush liquid body wastes, but a full flush, produced by depressing operating handle 22, will be necessary to adequately flush solid body wastes.

The parts of the first preferred embodiment which particularly function to terminate the full flush action early and thus produce a short flush will now be described.

Referring to FIG. 1, it will be understood that a collar 44 is clamped onto overflow pipe 20 by means, for instance, of a machine screw 46 cooperating with an oversized bore and a tapped bore in the usual manner.

An arm 48 extends outwardly from collar 44. A bore 50 of circular cross section passes through the outer end of arm 48. The length of arm 48 and its angular position about overflow pipe 20 are such that bore 50 is substantially coaxial with flush valve seat 12. A tube 52 is secured in bore 50 and projects downwardly from arm 48, as seen in FIG. 1. A plurality of holes are provided through the wall of tube 52 for reasons which will become apparent hereinafter. The bottom and top of tube 52 are both open, as seen in FIG. 1. A flange circular 56 is affixed to the lower end of tube 52. The function of flange 56 will be explained hereinafter.

A float 60, which generally takes the form of a toroid of substantially rectangular cross section, surrounds tube 52 when the water level in flush tank 24 is at its normal maximum height 62, as seen in FIG. 1. The toroidal shell of float 60 is sealed against the entry of water. For reasons which will become apparent hereinafter, a weight 62 may be located within the toroidal shell of float 60. An inwardly projecting circular flange 64 is affixed to or integral with the upper face of float 60. The inner diameter of flange 64 is slightly larger than the outer diameter of tube 52. The outer diameter of flange 56 is slightly smaller than the inner diameter of the circular passage 66 which extends vertically through the center of float 60. Thus, it will be evident to those having ordinary skill in the art, taught by the present disclosure, that as the water level in tank 24 drops during a flushing operation, float 60 can drop only so far that flange 64 contacts and bears upon flange 56, and no farther.

As will now be evident to those having ordinary skill in the art, the holes 54 in tube 52 are provided to release air or flush water which might otherwise be entrapped between float 60 and tube 52 as flanges 56 and 64 approach each other.

Float 60 will sometimes be called the "control float" herein.

Referring again to FIG. 1, it will be seen that a second collar surrounds and is clamped to overflow pipe 20, as by means of a machine screw 70, etc. In the first preferred embodiment collar 68 is of rectangular horizontal cross section, such that it provides a first planar face 72 substantially parallel to the plane of FIG. 1 (i.e., to front face 29) and a second planar face 73 (not shown) parallel to planar face 72 and located behind overflow pipe 20. A pivot pin 74 passes through a close-fitting bore 76 (not shown) which itself passes through collar 68 in a direction perpendicular to planar faces 72 and 73. Bore 76 may alternatively pass through two ears projecting from collar 68.

A flat metal member 78, which will sometimes be called a "latch" herein, is pivotably mounted on pivot pin 74 by means of a first arm 80 and a second arm 82 (not shown) which lies close to planar face 73. As seen in FIG. 1, latch 78 bears on the top of collar 68, and thus can go no lower than its horizontal (solid line) position.

Arm 80 terminates, beyond pivot pin 74, in a flat friction pad 84 which is resiliently biased inwardly (into contact with planar face 72) for frictional engagement with face 72. A similar friction pad 86 (not shown) is affixed to or integral with arm 82 at the opposite end of latch 78, and frictionally engages face 73. By means of friction pads 84 and 86 latch 78 is maintained in the position to which it was most recently operated (i.e., 78 or 78', FIG. 1) until it is forcibly moved from that position as described hereinafter.

Latch 78 is moved from its operative position (shown in solid lines in FIG. 1) to its inoperative position 78' (shown dashed in FIG. 1) by means of a push rod assembly 90 which will now be described.

Push rod assembly 90 comprises a first section 92 and a second section 94, the adjacent ends of which are received in a close-fitting sleeve 96. A coil spring 98 is contained within sleeve 96. A pair of stops 100, 102 are formed from sections 92 and 94 respectively and coact with slots in sleeve 96 to maintain the adjacent ends of sections 92 and 94 in sleeve 96. As will be evident to those having ordinary skill in the art, the purpose of sleeve 96, spring 98, etc., is to allow push rod assembly 90 as a whole to contract in length in response to compressive forces, rather than be bent thereby. The requirement for this resilient compressive force absorbing action will become apparent hereinafter.

The end of push rod section 94 remote from sleeve 96 is formed into an eye 104. Eye 104 is engaged with eye 28F, which is integral with rocker 28 as explained above. Further, as may be seen in FIG. 1, eye 104 closely embraces eye 28F. It follows, then, that whenever operating handle 22 is depressed push rod section 94 will be thrust to the left as seen in FIG. 1; and whenever operating handle 22 is raised, push rod section 94 will be pulled to the right as seen in FIG. 1.

The end of push rod section 92 remote from sleeve 96 is formed into an elongated eye 106. As best seen by comparison of FIGS. 1 and 2, elongated eye 106 is slidably confined between the head of a T-shaped member 108 and an arm 110 on which T-shaped member 108 is mounted, the shank of T-shaped member 108 passing through eye 106. As best seen in FIG. 2, arm 110 is itself affixed to arm 82, which with arm 80 (FIG. 1) movably supports latch 78.

It will thus be apparent to those having ordinary skill in the art, informed by the present disclosure, that whenever operating handle 22 is fully raised, until trip lever 36 contacts stop 38, latch 78 will be raised to its inoperative position (78'), unless it is already in that position.

It will also be apparent that whenever operating handle 22 is fully depressed, until trip lever 36 contacts stop 38, latch 78 will be moved to its operative position (shown in full lines in FIG. 1), unless it is already in that position.

An exception to this last-stated mode of operation may sometimes occur when operating handle 22 is depressed at the same time that float 60 has fallen, with the water in tank 24, to a position in which it can prevent latch 78 from moving to its operative position (shown in full lines in FIG. 1). When this situation occurs, spring 98 in sleeve 96 is momentarily compressed, and thus no damage to latch 78 or any other part of the mechanism of the first preferred embodiment results. It is to be noted that the mechanism of the first preferred embodiment is fail-safe in that even if the user holds down operating handle 32 at such a time as to bring latch 78 against float 60, and thus prevent float 60 from falling further a normal full flush operation will occur and come to its usual halt without damage to the mechanism and without an overflow condition resulting.

Before describing the operation of the device of the first preferred embodiment it should be noted that latch 78 bears upon the top of collar 68 in its operative position and thus cannot be depressed below its operative position.

An additional part of the device of the first preferred embodiment which is essential to its correct operation is the four-armed spider 112. Flush ball stem 16 passes through a close-fitting bore in the central part of spider 112 and spider 112 is affixed to stem 16 by conventional means, such as a set screw 114. As will be evident to those having ordinary skill in the art after completely reviewing the present disclosure, the amount of water discharged from flush tank 24 during a short flush can be varied over a wide range by suitably positioning spider 112 along flush ball stem 16.

OPERATION

In both modes of operation of the device of the first preferred embodiment of the present invention, i.e., the short flush mode and the full flush mode, trip lever 36 is raised by manual operation of operating handle 22 and in turn raises flush ball 10 out of contact with its seat 12. When flush ball 10 is raised far enough from seat 12, buoyancy forces prevent it from reseating itself and cutting off the outflow of flush water through discharge conduit 14.

In the full flush mode of operation flush ball 10 continues to be buoyantly supported by the water in tank 24 until the water level in tank 24 has dropped so far that flush ball 10 is reseated on seat 12 and cuts off the water flow into discharge conduit 14, whereupon tank 24 commences to refill in the well-known manner.

In the short flush mode of operation, on the other hand, control float 60 is deposited on spider 112 by the receding water in tank 24 well before the water in tank 24 has receded sufficiently to deposit flush ball 10 on its seat 12. As the water in tank 24 recedes further, the weight of float 60 forces flush ball 10 toward seat 12 until it drops onto seat 12 in the well-known manner and the flow of water into discharge conduit 14 is cut off. This cut off of flush water flow occurs when the water level in tank 24 is above the rest position of spider 112, as shown in FIG. 1, and tank 24 commences to refill in the well-known manner.

Thus, it will be seen that a full flush operation results if latch 78 is so positioned as to prevent float 60 from dropping onto spider 112 as the water in tank 24 recedes, while a short flush operation results if latch 78 is withdrawn to its inoperative (78') position and thus floats 60 can drop onto spider 112 and force flush ball 10 onto seat 12 as the water in tank 24 recedes.

As will be understood from FIG. 1, latch 78 is withdrawn to its inoperative (78') position whenever operating handle 22 is raised to the full extent permitted by stop 38, unless latch 78 was immediately previously in its inoperative position, in which case it remains there.

That is to say, the rightward (as seen in FIG. 1) movement of eye 106 produced by the raising of handle 22 can draw latch 78 rightwardly from its operative position to its inoperative position, but it cannot thrust latch 78 leftwardly from its inoperative position (78') to its operative position (full lines in FIG. 1) because the raising of handle 22 produces no net leftward movement of eye 106.

Thus, it will be seen that whatever the position of latch 78 just before the raising of handle 22 it will be in its inoperative position immediately after the full raising of handle 22.

Since, as shown above, a short flush operation always results if latch 78 is in its inoperative position when the water in flush tank 24 recedes, and since each full deflection of handle 22 (in either direction) causes the level of the water in flush tank 24 to recede, it follows that each full raising of operating handle 22 when the water in tank 24 is at maximum lever 62 results in a short flush operation, irrespective of the previous position of latch 78.

As may be seen from FIG. 1, latch 78 is either moved to its operative position or left in its operative position whenever operating handle 22 is fully depressed.

If latch 78 was immediately previously in its operative position, as shown in full lines in FIG. 1, the shank of T-shaped member 108 was then located in the left hand end of eye 106. The full depression of operating handle 22 causes eye 106 to move leftwardly (as seen in FIG. 1) by a distance approximately equal to its own length. Since the shank of T-shaped member 108 merely moves (relatively) from one end of eye 106 to the other no force is exerted on member 108 and thus latch 78 remains in its operative position.

If, on the other hand, latch 78 is in its inoperative position (78') then the shank of T-shaped member 108 is at or near the right hand end of eye 106 (as seen in FIG. 1), and when eye 106 is moved leftwardly by the full depression of operating handle 22 it pushes the shank of T-shaped member 108, and thus the entire latch assembly, into its operative position.

Since, as shown above, a full flush operation always results when latch 78 is in its operative position and the water in flush tank 24 recedes from maximum level 62, it follows that each full depression of operating handle 22 when the water in tank 24 is at maximum level 62 will result in a full flush operation, irrespective of the previous position of latch 78.

THE SECOND PREFERRED EMBODIMENT

Figures 3, 4, 5, 6:
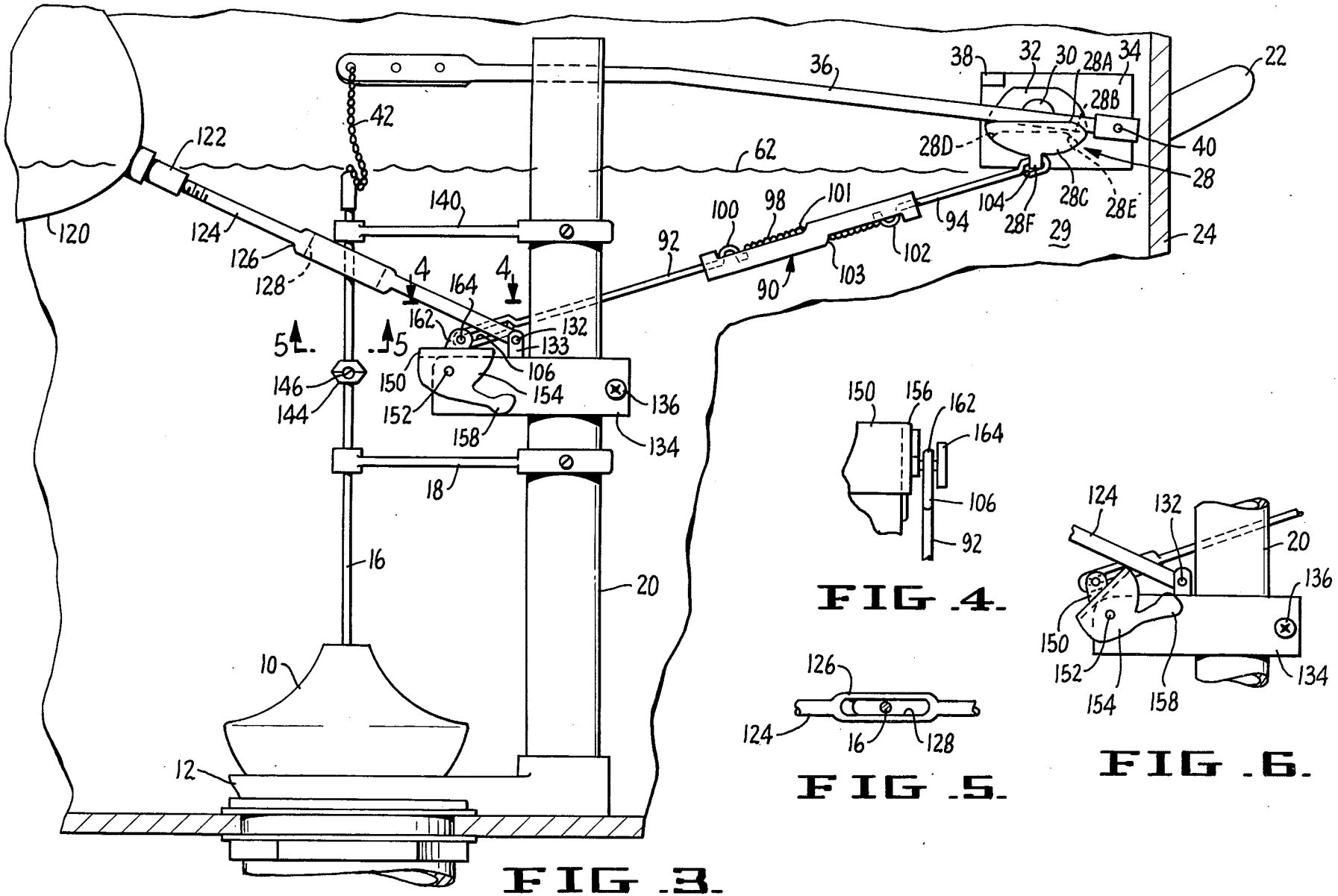
FIG. 3 is a fragmentary view in elevation of a standard toilet flush tank equipped with the flush water conservation system of a second preferred embodiment of the present invention.
FIG. 4 is a fragmentary plan view taken on line 4—4 of FIG. 3.
FIG. 5 is a fragmentary view taken on line 5—5 of FIG. 3.
FIG. 6 is a fragmentary view in elevation of one of the principal subassemblies of the flush water conservation mechanism of FIG. 3 illustrating a state of operation not illustrated in FIG. 3.

Referring now to FIG. 3, there is shown a flush water conserver constructed in accordance with a second preferred embodiment of the present invention installed in a toilet flush tank of the well-known type. For convenience in studying the present disclosure, those parts of the second preferred embodiment which are common to the first preferred embodiment are identified by the same reference numerals which identify the corresponding parts of the first preferred embodiment. Thus, the flush tank of the first preferred embodiment as shown in FIG. 1 and the flush tank of the second preferred embodiment as shown in FIG. 3 are both identified by the reference numeral 24, the operating handle of the first preferred embodiment as shown in FIG. 1 and the operating handle of the second preferred embodiment as shown in FIG. 3 are both identified by the reference numeral 22, etc. For the same reason, the cooperation of rocker 28, trip lever 36, stop 38, etc., will not again be described in connection with the second preferred embodiment. It suffices to point out here in the second preferred embodiment as in the first preferred embodiment rocking operating handle 22 in either direction from its position of rest lifts trip lever 36 from its lowest position, i.e., the position in which it is in maximum contact with rocker 28, as illustrated in FIGS. 1 and 3. Further, push rod assembly 90 in the device of the second preferred embodiment is substantially the same in structure and functions in substantially the same way as does push rod assembly 90 in the first preferred embodiment (FIG. 1).

Among the parts unique to the second preferred embodiment is a hollow metal or plastic float ball 120, of the kind well known and generally available in plumbing supply stores. Float ball 120 is provided with an inside-threaded mounting sleeve 122 of the well-known kind, and is thus affixed to the threaded end of a float arm 124.

In the central portion of float arm 124 there is provided an enlargement 126 (compare FIGS. 3 and 4). A vertically disposed opening 128 passes completely through enlargement 126. Opening 128 is sufficiently wide to accommodate flush ball stem 16 in loose-fitting relationship, as best seen in FIG. 5.

Float arm 124 is pivotably mounted on a pivot pin 132 which is itself mounted in a slotted stud 133 affixed to a collar 134. Collar 134 is clamped to overflow pipe 20 by means of a screw 136, etc. Collar 134 is generally rectangular in horizontal cross section and is provided with a rounded edge 138 as seen in FIG. 3.

In addition to stem guide 18, the flush ball stem 16 of the second preferred embodiment is also guided by a second stem guide 140. A float arm stop 144 is affixed to flush ball stem 16, as by means of a set screw 146. Ball chain 42 is fixed to the outer end of trip lever 36, and to the upper end of flush ball stem 16.

A latch 150 is pivotably mounted on a pivot pin 152 which extends through a close-fitting transverse bore in collar 134 by means of a perpendicular arm 154 (FIG. 3) and a second perpendicular arm 156 (FIG. 4) which generally resembles arm 154 in shape. Arm 154 is provided with a friction pad 158 which is resiliently biased against the adjacent face of collar 134 and in general serves the same function as friction pad 84 of the first preferred embodiment (FIG. 1). Arm 156 is provided with a similar friction pad 160 (not shown).

As may be seen by comparison of FIGS. 3 and 6, latch 150 may be pivoted into two positions, its inoperative position (FIG. 3) and its operative position (FIG. 6).

When latch 150 is in its operative position (FIG. 6) its upper edge blocks float arm 124 from pivoting downwardly about pivot 132, so that float arm 124 cannot drop substantially below the position it assumes when the water in flush tank 24 is at its maximum level 62 (FIG. 3).

When latch 150 is in its inoperative position (FIG. 3) it lies flat on the top surface of collar 134, and thus float arm 124 can pivot downwardly about pivot pin 132 until it contacts the outer edge of latch 150 (nearest pivot 152) and thus is disposed at a downward slope from pivot pin 132.

As may be seen by comparison of FIGS. 3 and 4, a position control arm 162 is attached to the outside face of arm 156 and the shank of T-shaped member 164 is affixed to the outer end of arm 162. The elongated eye 106 at the lower end of push rod assembly 90 is loosely contained between arm 162 and the head of T-shaped member 164, and the shank of T-shaped member 164 passes through eye 106.

OPERATION

As will now be apparent to those havng ordinary skill in the art, informed by the present disclosure, latch 150 of the second preferred embodiment is operated between its operative and inoperative positions by push rod assembly 90, which is in turn operated by operating handle 22 as described hereinabove in the description of the first preferred embodiment.

When a full flush operation is desired and thus operating handle 22 is depressed in the conventional manner, the concomitant rocking of rocker 28 thrusts push rod assembly 90 to the left (as seen in FIG. 3) and thus latch 150 is driven into its operative position, unless it is already in that position. Since latch 150 is in its operative position float arm 124 is prevented from dropping when the water in the flush tank 24 recedes as a result of flush ball 10 being withdrawn from its seat 12 by the same depression of operating handle 22. With float arm 124 prevented from dropping there will be no downward control force exerted on flush ball 10, and flush ball 10 will follow the usual and normal mode of operation, not returning to seat 12 and cutting off the outflow of water through discharge conduit 14 until the water level in tank 24 recedes far enough to deposit flush ball 10 on its seat 12. Thus, a full flush operation will be carried out by the device of the second preferred embodiment whenever operating handle 22 of the second preferred embodiment is depressed and the level of water in tank 24 is at the maximum level 62.

When operating handle 22 of the second preferred embodiment is fully raised, however, push rod assembly 90 is drawn to the right (as seen in FIG. 3) and thus latch 150 is drawn into its inoperative position (FIG. 3), unless it is already in that position. With latch 150 in its inoperative position float arm 124 can drop with the receding of the water in tank 24 until it assumes a position in which it slopes slightly downwardly from pivot pin 132. As float arm 124 drops it comes into contact with stop 144 and thereafter exerts a downward control force on stop 144, thus pushing flush ball 10 toward its seat 12 far earlier (i.e., at a higher water level in tank 24) than would be the case if float arm 124 were locked at or near its uppermost position by latch 150. Thus, it can be seen that whenever the water in tank 24 of the second preferred embodiment is at its maximum level and operating handle 22 is fully raised, a short flush operation takes place, the ratio between the amount of water discharged during a short flush operation and the amount of water discharged during a full flush operating being determined over a wide range by the position of stop 144 on stem 16.

In referring to the termination of the flush water outflow hereinabove it is sometimes said that this termination takes place when "the water level in tank 24 recedes far enough to deposit flush ball 10 on its seat 12," or the like. It will be understood by those having ordinary skill in the art, however, that such expressions as used herein do not refer to a quasistatic condition in which discharge conduit 14 is blocked and the water level in tank 24 is caused to recede by other means, but rather refer to the ordinary dynamic condition in which outflow through seat 12 and discharge conduit 14 continue while flush ball 10 is dropping toward seat 12 and thus an unbalanced condition is created whereby flush ball 10 will suddenly drop onto seat 12 and form a water seal therewith before it has reached its rest position on seat 12.

Figure 8:
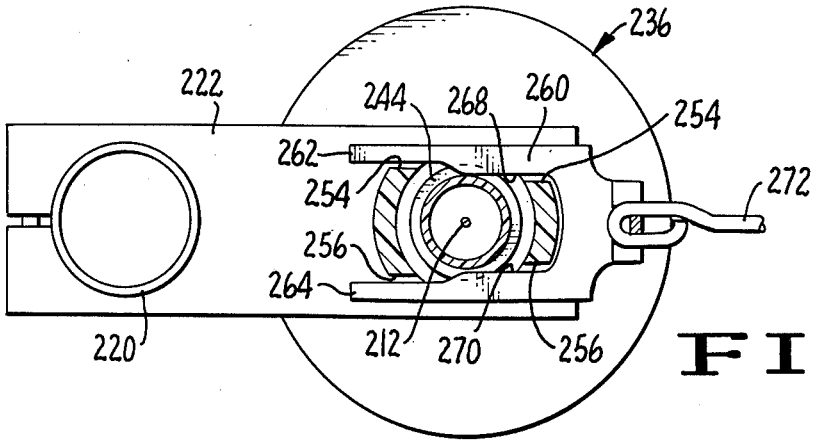
FIG. 8 is a sectional view taken on line 8—8 of FIG. 7.
Figure 7:
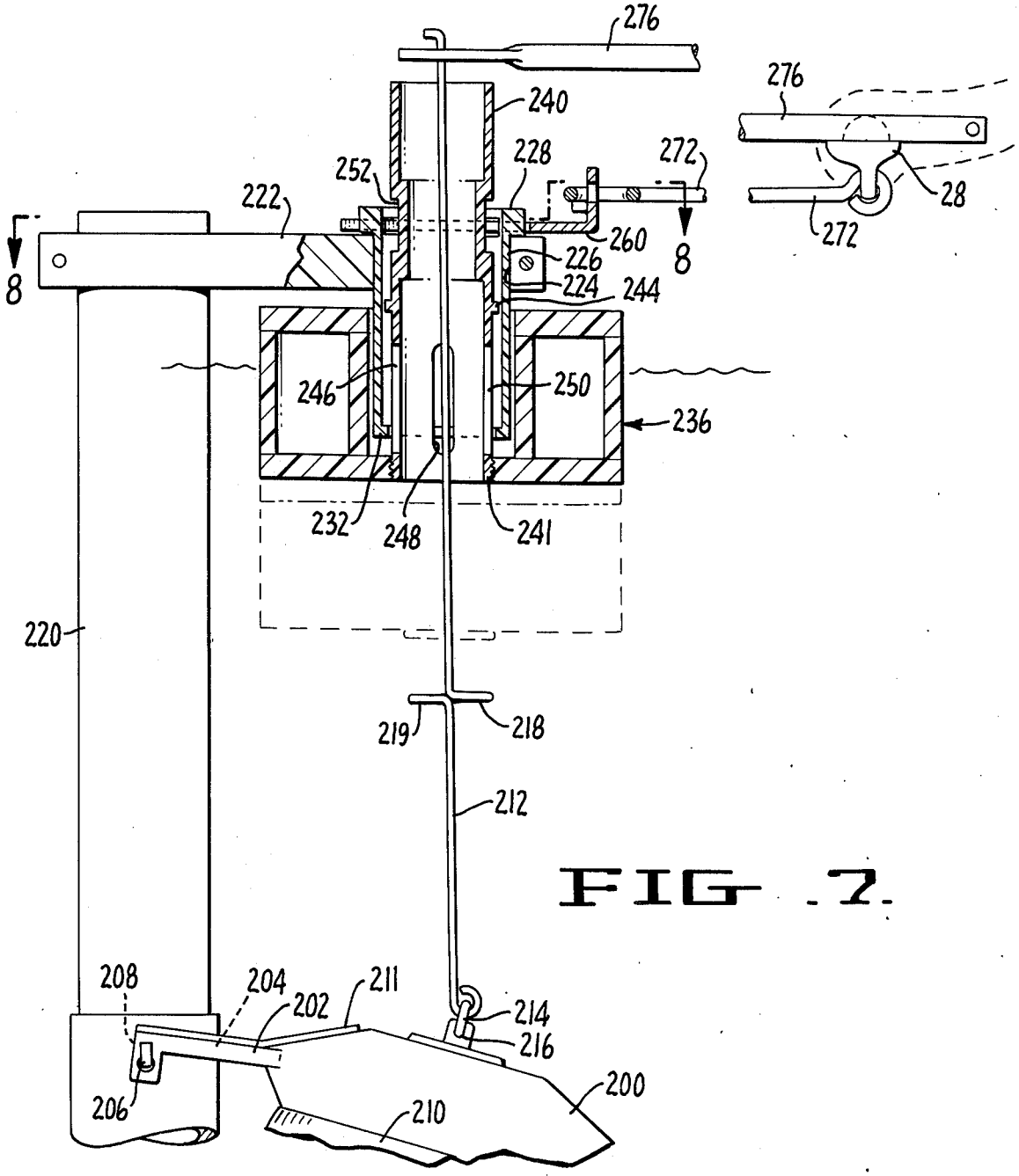
FIG. 7 is a fragmentary view in elevation of a third preferred embodiment of the present invention.

Referring now to FIGS. 7 and 8, there is shown a third preferred embodiment of the present invention.

As seen in FIG. 7, flush ball 200 of this embodiment may be of the now well-known type having a pair of projecting arms 202, 204. These arms, in the now well-known manner, may be provided with openings at their outer ends adapted to engage hinge pins 206, 208, which are themselves integral with flush valve seat 210.

It has been noted in preparing a model of the present invention, however, that stiffening means, such as deformable metal strip 211, should be added to both of the pivot arms 202, 204 in order to assure that the function of the third preferred embodiment employing this type of flush ball and flush valve seat is best carried out.

As will be evident to those having ordinary skill in the art, informed by the present specification and drawings, the older type of flush ball 10 and flush valve seat 12 (FIG. 1) may also be employed in certain specimens of the third preferred embodiment of the present invention.

Returning to FIG. 7, it will be seen that the stem 212 of flush ball 200 is affixed thereto by means of a hook in the lower end of stem 212 which is itself engaged with a ring 214, ring 214 passing through an opening in an ear 216 which is integral with flush ball 200.

It will also be seen in FIG. 7 that the separately fabricated spider 112 of FIG. 1 has been replaced in the third preferred embodiment with narrow, elongated, outwardly projecting loops 218, 219 formed from the stiff wire material of stem 212 itself.

The overflow pipe 220 of the third preferred embodiment is provided with an outwardly extending arm 222 which may be similar in structure and function to arm 48 of FIG. 1.

A bore 224 is provided in the outer end of arm 222, and a generally cylindrical tube or guide 226 passes through bore 224. Guide 226 is prevented from passing downwardly completely through bore 224 by a flange 228 which is integral with guide 226. A suitable nut and bolt arrangement is provided in the outer end of arm 222 for irrotatably clamping guide 226 in bore 224.

An inwardly projecting flange 232 is provided at the lower end of guide 226, which serves in general the same function as flange 56 of FIG. 1.

A toroidal float 236, which may be generally similar to float 60 of FIG. 1, is employed in the third preferred embodiment.

Float 236 is provided with a hollow, generally cylindrical stem 240. The lower end of stem 240 is provided with suitable external threads 241 which are interengaged with suitable internal threads in the center hole of the lower face plate of float 236, and thus affix float 236 to stem 240.

As also seen in FIG. 7, float stem 240 is provided with a centrally located continuous circular integral flange 244. Flange 244 coacts with flange 232 to limit downward movement of float 236 with respect to guide 226.

As will be evident to those having ordinary skill in the art, informed by FIG. 7, float 236 is assembled to guide 226 by first passing float 236 upwardly over guide 226 and then passing stem 240 downwardly through guide 226, whereafter the threads of float 236 and stem 240 are fully interengaged, securing float 236 to stem 240.

Stem 240 is also provided with a plurality of openings, e.g., 246, 248, 250, which prevent the damping effect which would otherwise be produced by water trapped between flanges 232 and 244, the wall of guide 226, and the wall of stem 240.

Stem 240 is also provided with a continuous, cylindrical groove or depression 252, the purpose of which will become evident hereinafter.

As may best be seen from FIG. 8, a pair of parallel, tangential cuts 254, 256 extend through flange 228 and into the interior of guide 226.

Cuts 254, and 256 close-fittingly receive fork-like latch member 260. As seen in FIG. 8, the tines 262, 264 of latch 260 are provided with stepped interior faces. At their inner ends the inner faces 268, 270 of tines 262, 264 are spaced apart by a distance slightly greater than the diameter of the bottom of groove or depression 252 in stem 240. The outer ends 268', 270' of the inner faces of tines 262, 264 are spaced apart by a distance greater than the maximum diameter of stem 240, exclusive of flange 244.

Thus, it will be seen that latch 260 can engage depression 252 and prevent float 236 from dropping below the position in which latch 260 engages the upper end of depression 252, when latch 260 is deeply engaged in cuts 254, 256, or can be withdrawn and permit float 236 to drop down until flanges 244 and 232 contact each other, when the outer, narrower ends of tines 262, 264 are engaged in cuts 254, 256.

The position of latch 260 is controlled by a push rod 272 which is similar to the push rod 90 of the first and second preferred embodiments excepting that it is not provided with the compression relief device including coil spring 98, etc. Push rod 272 is pivotably affixed to a trip lever lifter or rocker 28 substantially identical to trip lever lifter or rocker 28 of the first and second preferred embodiments.

The upper end of flush ball stem 212 is pivotably affixed to the outer end of a trip lever 276 similar to trip lever 36 of the first and second preferred embodiments, and operated by an operating handle and associated rocker in the same manner in which trip lever 36 is operated by operating handle 22 and rocker 28 of the first and second preferred embodiments.

In general, then, the mode of operation of the third preferred embodiment may be understood by those having ordinary skill in the art, informed by the present specification and drawings. It is to be noted, however, that in the third preferred embodiment arm 222 can be clamped to overflow pipe 220, whatever the orientation of overflow pipe 220 with respect to the front face of the flush tank, so that guide 226 is coaxial with flush valve seat 210, whereby smooth, non-binding operation of the third preferred embodiment is best insured. Further, it should be noted that because guide 226 can be clamped in arm 222 in any desired orientation, cuts 254 and 256 may be conveniently aligned with push rod 272, whereby to prevent binding between latch 260 and cuts 254, 256.

It will also be apparent to those having ordinary skill in the art, informed by the present specification and drawings, that the quantity of flush water emitted from the flush tank at each raising of the operating handle in the device of the third preferred embodiment may be adjusted by raising or lowering arm 222 on overflow pipe 220, arm 222 being lowered to increase the amount of flush water thus emitted, and being raised to decrease the amount of flush water thus emitted.

It will also be evident to those having ordinary skill in the art that when the device of the third preferred embodiment is applied to flush tanks which are not provided with an overflow pipe, guide 226 may alternatively be held in suitable position, i.e., above and coaxial with the discharge pipe, by means of a bracket which itself depends from the upper edges of the flush tank walls, the outer extremities of this bracket being, for example, provided with hook-shaped members which hook over the upper edges of the front and rear walls of the flush tank, but which are sufficiently thin so as not to interfere with the seating of the flush tank top on the upper edges of the front and rear walls of the flush tank, in the usual manner. This bracket will be provided with means such as thumbscrews for raising or lowering guide 226, and thus varying the amount of flush water emitted from the flush tank at each raising of the operating handle, by those having ordinary skill in the art without the exercise of invention.

It will be appreciated that by the abovedescribed constructions a flush water conserver is provided which carries out a normal flush operation whenever the tank is full and the operating handle of the toilet is depressed in the conventional manner and automatically alters its mode of operation to carry out a flush water saving short flush operation whenever the tank is full and the operating handle of the toilet is fully raised, irrespective of whether the previous flushing operation was a full flush operation or a short flush operation.

It will also be appreciated by those having ordinary skill in the art, informed by the present disclosure, that the flush water conserver device of the present invention, and particularly of the third embodiment, is so simple that it can be installed in an ordinary flush tank by an ordinary handyman having no particular skill in the flush tank art, and requires but a few parts which are not commercially available in plumbing supply houses, those few parts being largely of a kind which can be readily produced by means of the tools, fixtures, and techniques generally employed by the plumbing supplies manufacturers.

It will thus be seen that the objects set forth above, among those made apparent from the preceding description, are efficiently attained, and, since certain changes may be made in the above constructions without departing from the scope of the invention, it is intended that all matter contained in the above description or shown in the accompanying drawings shall be interpreted as illustrative and not in a limiting sense.

It is particularly noted that although the invention has been disclosed as embodied in three devices all of which carry out a full flush operation when the operating handle is depressed and a short flush operation when the operating handle is raised it is within the scope of the present invention to so alter the position and configuration of the push rods that the depression of operating handle 22 results in a short flush and the raising of operating handle 22 results in a full flush.

It is also to be understood that the following claims are intended to cover all of the generic and specific features of the invention herein described, and all statement of the scope of the invention which, as a matter of language, might be said to fall therebetween.

What is claimed is:

1. A flush toilet, comprising:

a single operating handle operable in a first direction to produce a full flush and operable in a second direction to produce a short flush;

flush ball means for permitting the outflow of flush water from the flush toilet tank when withdrawn from its seat by operation of said operating handle in either direction;

auxiliary float means for bearing upon said flush ball means and urging said flush ball means towards its seat when the surface of the water in said tank has receded from its quiescient level by a predetermined distance; and latch means for preventing said auxiliary float means from dropping far enough to bear upon said flush ball means when latched;

said latch means, if unlatched, being moved in a latching direction to a latching position for preventing said auxiliary float means from thus dropping when said operating handle is moved in said first direction, and, if latched, being moved in an unlatching direction to a non-latching position for permitting said auxiliary float means to bear upon said flush ball means when said operating handle is moved in said second direction.

2. A flush toilet as claimed in claim 1 in which said flush ball means is provided with a substantially rigid stem and said stem passes through said auxiliary float means.

3. A flush toilet as claimed in claim 1 in which said latch means is moved in both of said directions by lost motion linkage means, and said lost motion linkage means is pivotably affixed to a crank member operated by said operating handle.

4. A flush toilet as claimed in claim 3 in which said flush ball means is provided with a substantially rigid stem and said stem passes through said auxiliary float means.

5. A flush toilet as claimed in claim 3, further comprising guide means mounted on the flush tank overflow pipe for guiding said latch means, said guide means and said latch means being angularly adjustable about a vertical axis to accommodate various placements of said overflow pipe in said flush tank.

6. A flush toilet as claimed in claim 5 in which said flush ball means is provided with a substantially rigid stem and said stem passes through said auxiliary float means.

* * * * *